US005469727A

United States Patent [19]

Spahn et al.

[11] Patent Number: 5,469,727

[45] Date of Patent: Nov. 28, 1995

[54] ELECTRONIC LOCK CYLINDER

[75] Inventors: Karl-Heinz Spahn, Ostbevern; Helmut Aswegen, Drensteinfurt; Franz Schwerdt, Telgte, all of Germany

[73] Assignee: Aug.Winkhaus GmbH & Co. KG, Telgte, Germany

[21] Appl. No.: 27,664

[22] Filed: Mar. 8, 1993

[30] Foreign Application Priority Data

Mar. 6, 1992 [DE] Germany ..... 42 07 161.5

[51] Int. Cl.[6] ..... E05B 49/00

[52] U.S. Cl. ..... 70/278; 70/277; 70/413; 70/408; 340/825.31

[58] Field of Search ..... 70/277–282, 395, 70/413; 235/375, 382, 492; 200/305; 439/449, 456, 459, 460, 470; 307/10.1, 10.2; 340/825.31, 825.32, 542, 543; 361/172, 679, 732

[56] References Cited

U.S. PATENT DOCUMENTS

| | | | |
|---|---|---|---|
| 4,845,347 | 7/1989 | McCrindle et al. | 235/380 |
| 4,849,749 | 7/1989 | Fukamachi et al. | 340/825.31 |
| 4,899,036 | 2/1990 | McCrindle et al. | 235/380 |
| 4,908,605 | 3/1990 | Takatsuka | 340/542 |
| 4,924,686 | 5/1990 | Vonlanthen | 70/279 X |
| 4,947,662 | 8/1990 | Imedio | 70/277 X |
| 5,003,801 | 4/1991 | Stinar et al. | 70/278 |
| 5,043,593 | 8/1991 | Tsutsumi et al. | 70/278 X |
| 5,117,097 | 5/1992 | Kimura et al. | 70/278 X |
| 5,156,032 | 10/1992 | Edgar | 70/278 |
| 5,195,341 | 3/1993 | Nieuwkoop | 70/278 |

FOREIGN PATENT DOCUMENTS

| | | | |
|---|---|---|---|
| 0077101 | 4/1983 | European Pat. Off. . | |
| 0089087 | 9/1983 | European Pat. Off. . | |
| 98437 | 1/1984 | European Pat. Off. . | |
| 0147099 | 7/1985 | European Pat. Off. . | |
| 0239341 | 9/1987 | European Pat. Off. . | |
| 0288791 | 11/1988 | European Pat. Off. . | |
| 324096 | 7/1989 | European Pat. Off. . | |
| 0287686 | 7/1990 | European Pat. Off. . | |
| 2537642 | 6/1984 | France . | |
| 2607545 | 6/1988 | France . | |
| 2634303 | 2/1978 | Germany . | |
| 2824684 | 12/1979 | Germany . | |
| 3043595 | 6/1982 | Germany . | |
| 3245681 | 7/1983 | Germany . | |
| 3244566 | 6/1984 | Germany . | |
| 3515888 | 5/1985 | Germany . | |
| 3402737 | 8/1985 | Germany . | |
| 3507871 | 11/1985 | Germany . | |
| 3500353 | 7/1986 | Germany . | |
| 3707201 | 3/1987 | Germany . | |
| 3544689 | 7/1987 | Germany . | |
| 3701576 | 10/1987 | Germany . | |
| 3800414 | 7/1989 | Germany . | |
| 3806469 | 9/1989 | Germany . | |
| 8911016 | 12/1989 | Germany . | |
| 4036575 | 6/1991 | Germany . | |
| 4011178 | 1/1992 | Japan | 70/277 |

(List continued on next page.)

OTHER PUBLICATIONS

Stettner Product Sheet, Miniature Chip Coils, Series 5130 and 5135, Jun. 6, 1991.

*Primary Examiner*—Peter M. Cuomo
*Assistant Examiner*—Suzanne L. Dino
*Attorney, Agent, or Firm*—Brumbaugh, Graves, Donohue & Raymond

[57] ABSTRACT

An electronic lock cylinder comprises a housing (1) with a cylinder core (9) disposed rotatably therein and lockable by a key (15) via mechanical tumblers (21). Electronic control circuits (45, 47) capable of being coupled inductively via coupling coils (43, 49) for the transmission of coding information, are associated with the lock cylinder and the key (15). The coupling coil (43) of the lock cylinder, and the electronic components included in the lock cylinder and a mounting (51), are combined into a structural unit which is removably attached to a front face of the lock cylinder. This permits separate assembly of the mechanical components and of the electronic components of the lock cylinder.

11 Claims, 3 Drawing Sheets

FOREIGN PATENT DOCUMENTS

| | | | |
|---|---|---|---|
| 4080482 | 3/1992 | Japan | 70/277 |
| 592797 | 1/1978 | Switzerland . | |
| 641582 | 2/1984 | Switzerland . | |
| 664595 | 3/1988 | Switzerland . | |
| 668616 | 1/1989 | Switzerland . | |
| 671800 | 9/1989 | Switzerland . | |
| 2225371 | 5/1990 | United Kingdom . | |

ELECTRONIC LOCK CYLINDER

BACKGROUND OF THE INVENTION

The invention concerns a lock cylinder and, in particular, a lock cylinder having tumblers mechanically lockable by a key which permits the transmission of coding information between an electronic control circuit of the key and an electronic control circuit of the lock cylinder.

European Patent Document EP-A-0,324,096 discloses a profile lock cylinder comprising a profile housing and a cylinder core rotatably seated in a bore of the profile housing, having a keyway extending in the direction of the axis of the cylinder for insertion of a flat key. The key controls not only mechanical tumblers of the lock cylinder but includes an electronic control circuit in its bow section. Inductively via a key-side coupling coil, the control circuit transmits coding data to a coupling coil on the profile housing. An additional electronic control circuit connected to the coupling coil of the lock cylinder evaluates the transmitted coding data and, upon agreement between key-side and lock-cylinder-side coding data, generates a control signal corresponding to the lock status. In addition to the tumblers mechanically actuable by the key, the lock cylinder comprises an electromagnetic locking means which also blocks the cylinder core relative to the profile housing, and which can be unlocked by the control signal.

The coupling coil of the lock cylinder disclosed in European Patent Document EP-A-0,324,096 is disposed in a mounting of synthetic material which is held at one front end of the profile housing by means of integral locking members. The mounting of synthetic material projects beyond the front face of the cylinder core, to bring the coupling coil nearer to the coupling coil disposed in the bow on the key side. In a door-mounted lock, for example, the mounting of synthetic material thus projects a few millimeters beyond the front of a door plate, resulting in a risk of unintentional damage and unauthorized manipulations.

Usually, the magnetic fields of the coupling coils are comparatively small, and the signals produced by the lock-cylinder-side coupling coil are also comparatively small. This makes it necessary to place the electronic control circuit as close as possible to the coupling coils, to reduce signal losses and interference. In known electronic lock cylinders responding to coding information of the key, the electronic control circuit or at least some of its components may be accommodated within the housing of the lock cylinder. However, assembly of this type of lock cylinder is difficult, as electronic and mechanical components have to be assembled simultaneously.

SUMMARY OF THE INVENTION

It is an object of the invention to provide a lock cylinder which is more readily assembled.

A lock cylinder comprises a housing, at least one cylinder core seated rotatably in a bore of the housing and having a keyway extending in an axial direction of the cylinder for insertion of a key, a plurality of tumblers mechanically controllable by the key, and a detachable mounting on the housing with a communications element, in particular a coupling coil disposed near the keyway. Upon insertion of the key into the keyway, this communications element is coupled with a key-side communications element, e.g., likewise a coupling coil of a key-side electronic control circuit for the transmission of coding information. A lock-cylinder-side electronic control circuit is connected to the lock-cylinder-side communications element, for generating a control signal as a function of transmitted coding information, representing the lock status, for control of an electromagnetic locking means included in addition to the tumblers. In a preferred embodiment of the invention, at least some of the components of the electronic control circuit are disposed at the housing of the lock cylinder, in a detachable structural unit comprising the communications element and the mounting.

DETAILED DESCRIPTION OF PREFERRED EMBODIMENTS

Figure 1:
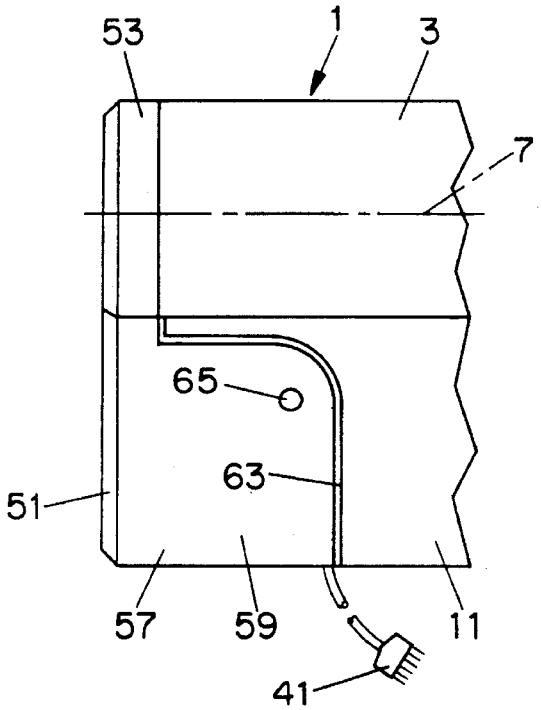
FIG. 1 is a partial view of an electronic lock cylinder.
Figure 2:
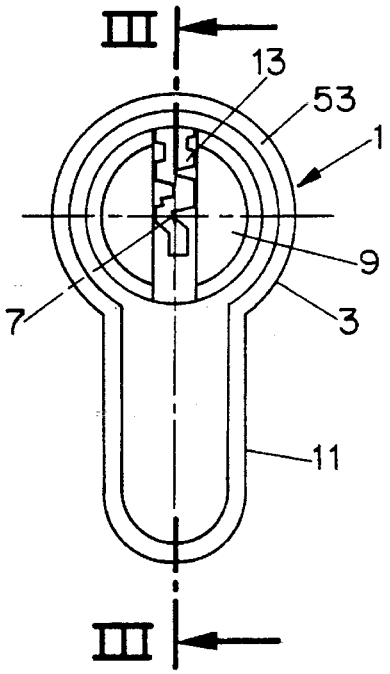
FIG. 2 is a front view of the lock cylinder of FIG. 1.

In a preferred embodiment of the invention, at least the input and/or output stages for signal transmission are disposed in the immediate vicinity of the coupling coils, thereby minimizing interference. Also, the mechanical components of the lock cylinder and the electronic components can be assembled as separate structural units, for combination in a final manufacturing step. Advantageously, in case of a defect, the electronic structural unit can be replaced at the site of installation of the lock cylinder, without requiring replacement of the mechanical portion of the lock cylinder.

In a preferred embodiment of the invention, wherein the housing is a profile housing of a profile lock cylinder and comprises a cylinder section including the bore for the cylinder core as well as a root section projecting radially from the cylinder section, wherein the mounting covers at least the axial front face of the root section, the mounting has an opening coaxial with the bore, into which there engages an extension of the cylinder core projecting from the bore engages, and wherein the components of the control circuit at the housing are on a circuit chip transverse to the cylinder axis near the front of the root section.

A lock cylinder of this type may be built of conventional lock cylinder components essentially. In particular, a standard lock cylinder may be used, with slight modification of the cylinder core and the profile housing. There is no need to depart from the standard outside dimensions of conventional profile cylinders, so that conventional security door mountings and doorplates can be used to cover the lock cylinder. Since the mounting substantially forms the entire front of the profile housing, it is sufficiently sturdy and may alternatively be permanently attached to the profile housing. The circuit chip, disposed approximately parallel to the front face of the root section, can detect attempts at drilling. Indeed, if the tumbler region is drilled open, the circuit chip is damaged first, which may trigger an alarm.

The mounting consists of a nonmagnetic material, e.g., a synthetic material or a nonferromagnetic metal, and advantageously has an offset adapted to the outer contour of the root section, projecting in the direction of the cylinder axis over an annular section forming the opening, and including a pocket into which the root section engages. Such a mounting can be attached mechanically sturdily and permanently to the profile housing, especially if the pocket is delimited on both sides of the root section by side pieces of the offset, seated in like-contoured depressions of the side faces of the root section, and if the mounting is attached, e.g., screwed, to the profile housing by pinlike fastening elements engaging transverse to the cylinder axis in the root section through the side walls. The mounting is guided by the like-contoured edges of the mutually adjacent side walls and of the depressions, secure against tilting and turning and form-lockingly on the root section, so that few fastening elements, e.g., one fastening element on each side, are sufficient for permanent attachment.

The cylinder-core extension engages in the opening of the mounting and thus contributes to sturdiness. The prolongation may be formed on the cylinder core in one piece; alternatively, it may form a cap separate from the cylinder core, disposed on a projection at the front end of the cylinder core. Advantageously in the manufacture of this embodiment, a standard cylinder core can be used, as only a seat must be formed on the cylinder core for desired prolongation through the cap. Other dimensions need not be changed, in particular those of the annular flange or the like generally provided for axial guidance of the cylinder core. For axial guidance of the cap on the profile housing, the cap advantageously has an annular flange, projecting radially outward from the cylinder axis, which is engaged between the mounting and the cylinder section of the profile housing. The cap may be coupled rotationally fixed with the cylinder core by projections or the like, so that an opening provided in the cap for insertion of the key cannot be turned relative to the keyway of the cylinder core.

In the lock cylinder disclosed in the above-referenced European Patent Document EP-A-0,324,096, the coupling coil is disposed at the front face of the cylinder and cooperates with the coupling coil accommodated in the bow of the key. In this case, the front face of the lock cylinder has to be prolonged beyond the front face of the cylinder core to the key bow, to ensure sufficient proximity of the couplings.

Another lock cylinder is disclosed in German Patent Document DE-A-4,036,575, including a coupling coil at the side of a cylinder core rotatable in a housing. The coupling coil is disposed on a U-shaped yoke whose arms surround a keyway, open at both sides, in the cylinder core. A cylindrical coupling coil is disposed in the shank of the corresponding flat key at a distance from the key bow, extending between the narrow sides of the key shank. Upon insertion of the key into the keyway of the cylinder core, this coupling coil is guided between the arms of the yoke of the lock-cylinder side coupling coil. A lock cylinder of this type requires a special cylinder housing, and the coupling coil extending through the whole key shank greatly weakens the shank, so that there is a risk of the key breaking off in the event of improper handling.

In accordance with a further aspect of the invention, a profile lock cylinder with inductive data transmission from a flat key to the lock cylinder, while being a substantially conventional lock cylinder, provides for protection of the cylinder-side coupling coil, Also, weakening of the key in its shank region is prevented.

Such a profile lock cylinder comprises the following components:

A profile housing, at least one cylinder core seated rotatably in a bore of the profile housing and having a keyway extending in the direction of the axis of the cylinder for a flat key, a plurality of tumblers mechanically controllable by the flat key, and a coupling coil which disposed in the region of a front face of the profile housing and which, upon insertion of the key in the keyway, is capable of being coupled with a key-side coupling coil of a key-side electronic control circuit for inductive transmission of coding information. A lock-cylinder-side electronic control circuit is connected to the lock-cylinder-side communications element, for generating a control signal as a function of transmitted coding information, representing the lock status, for control of an electromagnetic locking means included in addition to the tumblers. In such a lock cylinder, in the region of the front face of the profile housing, the keyway is open radially toward the profile housing on at least one of its narrow sides, the lock-cylinder-side coupling coil is disposed such that, in the rest position of the lock cylinder permitting insertion of the flat key in the keyway, it is aligned toward the narrow-side opening of the keyway, and the key-side coupling coil is disposed in the region of the narrow side of a section of a key shank of the flat key capable of insertion in the keyway.

Under utilization of the space in the root section of the profile cylinder, the lock-cylinder-side coupling coil is protected within the profile housing, so that it can be inductively coupled directly with a key-side coupling coil disposed on a narrow side of the key shank. Since the key-side coupling coil does not extend all the way through the key shank, the key shank is not mechanically weakened, and accommodation of the lock-cylinder-side coupling coil within standard dimensions of a profile cylinder is readily feasible.

Preferably, this further aspect of the invention is realized in a cylinder lock of the type described for an object of the invention, in which the electronic components in the housing of the lock cylinder are combined into a structural unit. This applies especially when the lock-cylinder-side coupling coil is on a circuit chip which also includes at least some of the electronic components of the control circuit. Thus, the comparatively small lock-cylinder-side coupling coil can be mounted more easily in the profile housing.

In a flat key which is suitable for a lock cylinder of the type described, the key-side electronic control circuit is advantageously arranged in a bow of the flat key, where the key shank, in the region of the bow, has a flat-side widening which forms an insertion-stop face pointing away from the bow. The insertion-stop face, cooperating with a counterstop face of the cylinder core, provides for axial adjustment of the flat key relative to the mechanical tumblers of the lock cylinder. Preferably, the key-side coupling coil is disposed on a narrow side of the flat-side widening extending in the longitudinal direction of the shank between the stop face and the bow, i.e., at a location at which the key shank already has high strength owing to the flat-side widening. The coupling coil is advantageously disposed in a recess of the flat-side widening, from which a bore entirely in the interior of the key shank connects to the interior of the bow for accommodation of connecting lines of the coupling coil. Since the recess extends all the way into the stop face, the bore may alternatively be from the stop face, which also facilitates installation of the coupling coil in the recess. To protect the coupling coil, the recess does not extend all the way into the flat sides of the key shank, so that the coupling coil is covered by flat-side side walls.

In the following, exemplary embodiments are described with reference to the figures.

Figure 3:
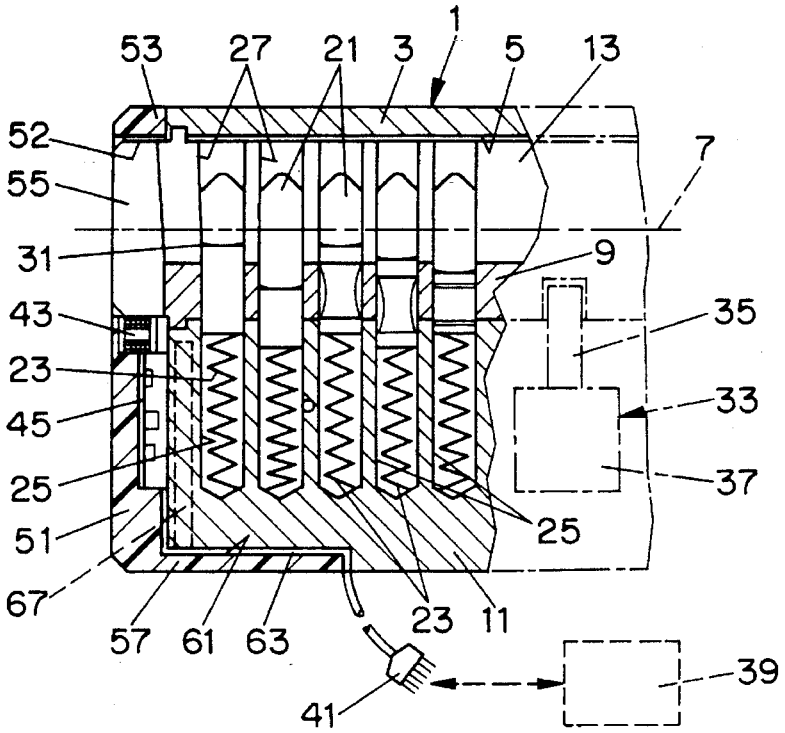
FIG. 3 is a cross section of the lock cylinder of FIG. 1 and 2, at the line III—III in FIG. 2.
Figure 4:
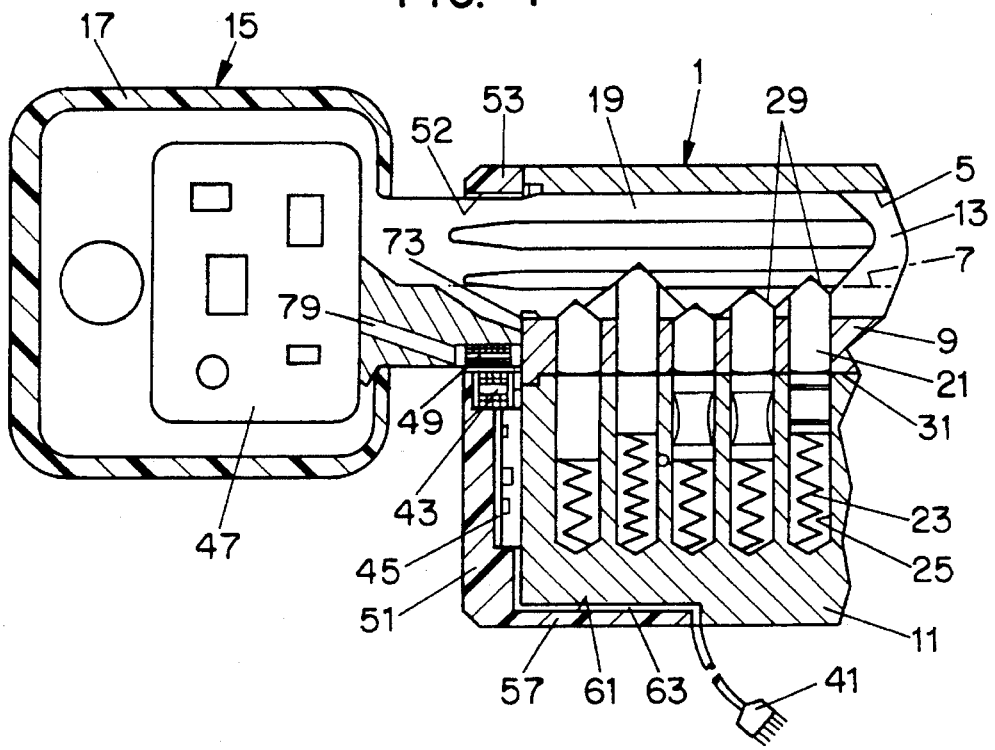
FIG. 4 is a cross section similar to FIG. 3, but with a partially inserted flat key shown in partial cross section.

The profile lock-cylinder shown in FIGS. 1 to 4 has a profile housing 1 with a cylinder section 3 which, in a cylindrical bore 5, contains a cylinder core 9 rotatable about its cylinder axis 7, as well as a root section 11 projecting radially from the cylinder axis 7. The cylinder core 9 contains a keyway 13 for a flat key 15 (see FIG. 4), whose key shank 19, projecting from a bow 17, controls mechanical pin-tumbler pairs 21 in conventional fashion. The pin-tumbler pairs 21, biased by springs 23 against the cylinder core 9, are disposed in bores 25, 27 of the root section 11 and of the cylinder core 9. The bores 25, 27, in a rest position of the cylinder core 9 in which the flat key 15 can be inserted or removed, are aligned coaxial to one another. FIG. 3 shows the locked position of the lock cylinder when the key is removed, with the pin-tumbler pairs 21 extending radially away over the surface of the cylinder core 9 into the root section 11 and blocking the cylinder core 9. FIG. 4 shows the lock cylinder with an inserted flat key 15 whose key notches 29 align the separating surfaces 31 of the pin-tumbler pairs 21 to the surface of the cylinder core 9, so that the latter can be turned relative to the profile housing 1.

In addition to the mechanical tumblers, the lock cylinder is lockable by an electromagnetic locking means 33. The locking means 33 blocks the cylinder core 9, e.g., by means of a spring-loaded anchor 35, and comprises an electromagnet 37 which, upon supply of a control pulse, actuates the anchor 35 and releases the cylinder core 9 for the duration of the control pulse for turning by the flat key 15.

For control of the locking means 33, an electronic control circuit 39 is associated with the lock cylinder, with its main components outside the lock cylinder, e.g., in the region of the lock associated with the lock cylinder, or outside the door or the like locked by the lock, and is connected via a connecting line separable by plug-type connectors 41 with a coupling coil 43 on the lock cylinder. Some of the electronic components of the electronic control circuit 39 are disposed in the immediate vicinity of the coupling coil 43 on a circuit chip 45 in the lock cylinder, for processing of the relatively weak signals of the coupling coil 43 free of interference.

An additional electronic circuit 47, connected with an additional coupling coil 49 in the key shank 19, is disposed in the bow 17 of the key. If the flat key 15 is inserted in the lock cylinder as shown in FIG. 4, the coupling coils 43, 49 are mutually aligned and inductively coupled. The control circuits 39, 47 transmit coding information in both directions, as a function of which the control circuit 39 generates the control pulse for unlocking the locking means 33 when the information matches. For placement of the coupling coils 43, 49 close together, the region of the coupling-coil-side narrow side of the keyway 13 is open near the coupling coil 43 in the rest position of the cylinder core 9, and the coupling coil 43 directly adjoins the periphery of the cylinder core 9.

The circuit chip 45 bears all lock-cylinder-side electronic components of the control circuit 39 and is combined with the coupling coil 43 and a mounting 51 into a structural unit which is detachably attached to the profile housing 1. Thus, the mechanical components of the lock cylinder can be assembled separately from the electronic components, with the electronic components added only in a final step of assembly. In case of defect, the electronic components can be replaced without replacement of the mechanical components of the lock cylinder.

To this end, the mounting 51 which may consist of a synthetic material or an otherwise nonmagnetic material, is formed as a shaped part and disposed at the front end of the profile housing 1. By an annular part 53 forming an opening 52, the mounting 51 surrounds a front axial extension 55 of the cylinder core 9. Next to the annular part 53, the mounting 51 has an offset 57. The offset 57 has a contour corresponding to the outer contour of the root section 11 and forms a pocket 61 in which the root section 11 engages between two side walls 59, of which only one is shown in FIG. 1. In its region engaged in the pocket 61, the root section 11 has a like-contoured recess 63 which surrounds the offset 57 form-lockingly with its edges, so that the mounting 51 is guided on the lock cylinder substantially secure against tilting. Pins or screws 65 fix the mounting 51 on the root section 11 in the region of the side walls 59.

The chip 45 extends perpendicular to the cylinder axis 7 and overlaps the front face of the root section 11. In case of an attempt at drilling to destroy the tumbler bores 25, the chip 45 is damaged first. This can be detected by the control circuit 39 as attempted sabotage, to trigger an alarm. Furthermore, hardened steel pins 67 or the like may be inserted in the root section 11 between the mounting 51 and the row of pin tumblers as protection against drilling.

Figure 5:
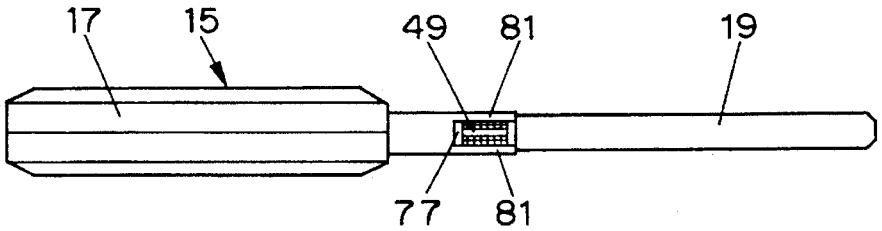
FIG. 5 is a narrow-side view of the flat key.
Figure 6:
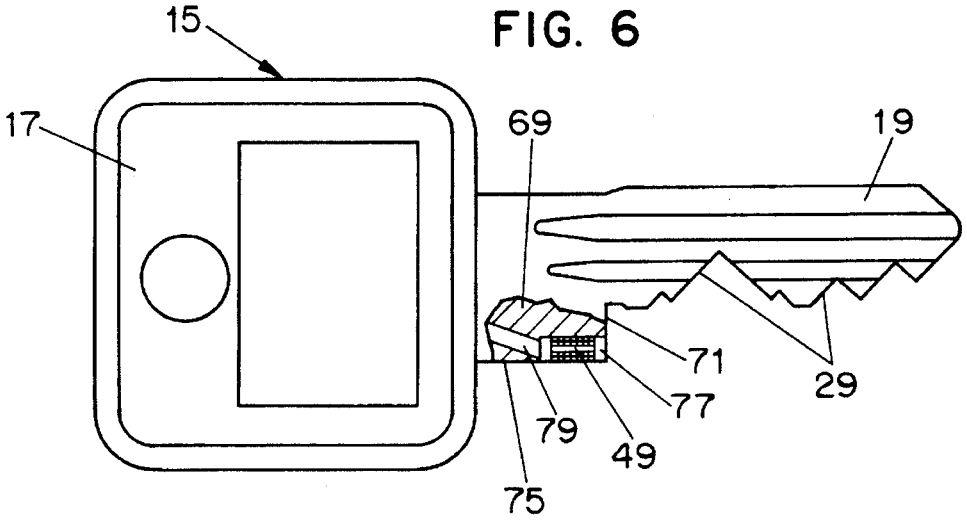
FIG. 6 is a flat-side view of the flat key.

FIGS. 4 to 6 show details of the flat key 15 which, in the region of the base of its key shank 19, has a flat-side widening 69 engaging in the extension 55 of the cylinder core 9 when the key is inserted. The flat-side widening 69 forms a stop face 71, directed away from the bow 17 and fixing the key on a counterstop face 73 (see FIG. 4) of the cylinder core 9 for mechanical operation of the lock cylinder. Also, the stop faces 71, 73 provide for alignment of the coupling coils 43, 49. The coupling coil 49 is disposed in a recess 77 of the flat-side widening 69, open toward the stop face 71 and toward the narrow side 75, and its connecting lines to the control circuit 47 lead through a bore 79 from the recess 77, entirely in the interior of the key shank 19. The bore 79 is oblique to the longitudinal direction of the shank. Toward the flat sides of the shank 19, the recess 77 is delimited on both sides by flat-side side walls 81 which protect the coupling coils 49 at the side. The coupling coil 49 may be encapsulated by a casting compound in the recess 77. The coupling coil 43, the mounting 51 and, optionally, the circuit chip 45 may likewise be encapsulated.

Figure 7:
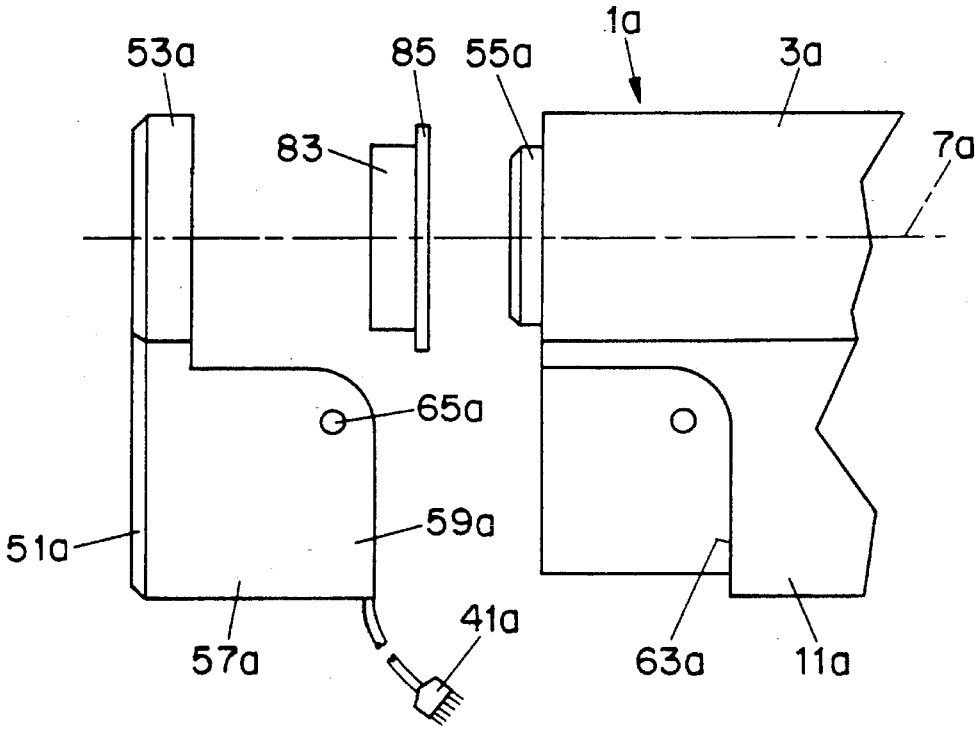
FIG. 7 is an exploded view of a variant electronic lock cylinder.
Figure 8:
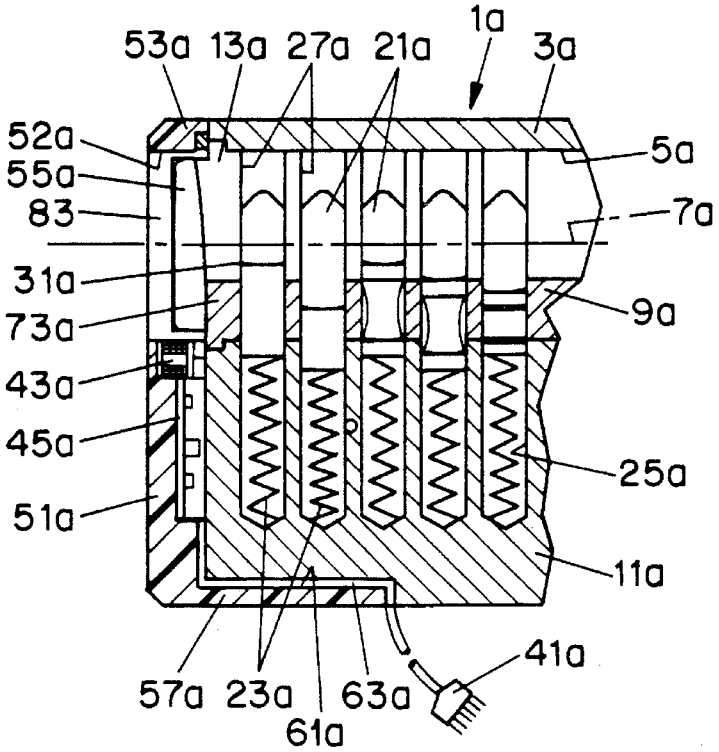
FIG. 8 is a cross section of the lock cylinder of FIG. 7.

The profile lock cylinder of FIGS. 7 and 8 differs from the lock cylinder described above only in the design of the insert side of its cylinder core. Analogous components are labelled with reference symbols in correspondence with the numerals of FIGS. 1 to 6. Structure and operation are analogous also. Although present, the key-side components and the components 33 and 39 are not shown in FIGS. 7 and 8.

While the axial extension 55 of the lock core 9 in FIG. 3 penetrates the annular part 53 of the mounting 51 in its entire depth, the prolongation **55*a* of the cylinder core 9*a* of the lock cylinder of FIGS. 7 and 8 is shorter, so that the extension 55*a* can be produced by machining of a conventional cylinder core with standard dimensions. A cap 83, with a key-insertion slot in its bottom and in at least one of its side walls, is placed on the extension 55*a* for further lengthening to the outside of the mounting 51*a*. The cap 83 has a completely surrounding annular flange 85 which projects radially and which engages in an annular groove between the annular part 53*a* and the cylinder section 3*a* of the profile housing 1*a*, axially fixing the cap 83. Not shown is a projection of the cap 83 which engages in the keyway 13*a* of the cylinder core and fixes the cap 83 on the cylinder core 9*a*** against rotation.

We claim:

1. A lock cylinder comprising a profile housing of a profile lock cylinder, the housing including a cylinder section having a bore for a cylinder core and a root section projecting radially from the cylinder section and having an axial front face, at least one cylinder core disposed rotatably in the bore of the housing and having a keyway extending in the direction of a cylinder axis for insertion of a key and a plurality of tumblers mechanically controllable by the key, a detachable mounting on the housing and having a portion covering at least the axial front face of the root section and having an opening coaxial with the bore and receiving an extension of the cylinder core projecting from the bore, the extension being a cap separate from the cylinder core and being received on a projection on the front end of the cylinder core, a first information transmitter/receiver element disposed in the vicinity of the keyway which upon insertion of the key into the keyway is capable of being coupled with a second transmitter/receiver element of an electronic control circuit of the key for transmission of coding information, an electronic control circuit of the lock connected to the first transmitter/receiver element which, as a function of transmitted coding information, transmits a control signal representing a lock status, the electronic control circuit of the lock including a circuit chip, the circuit chip of the electronic control circuit of the lock, and the first information transmitter/receiver element, and the mounting forming a structural unit that is removably attached to the housing.

2. The lock cylinder of claim 1, wherein the transmitter/receiver element on the housing comprises a coupling coil.

3. The lock cylinder of claim 1, wherein the transmitter/receiver element on the key comprises a coupling coil.

4. The lock cylinder of claim 1, and further comprising electromagnetic locking means for locking the cylinder core and the tumblers in response the control signal.

5. The lock cylinder of claim 1, wherein the mounting has an offset adapted to the outside contour of the root section, which projects in the direction of the cylinder axis over an annular section forming the opening and including a pocket in which the root section is engaged.

6. The lock cylinder of claim 5, wherein the pocket is delimited on both sides of the root section by side walls of the offset which are disposed in like-contoured depressions of the side faces of the root section, the mounting being attached to the profile housing by pinlike fastening elements engaged in the root section transverse to the cylinder axis through the side walls.

7. The lock cylinder of claim 1, wherein the cap has an annular flange projecting radially outward from the cylinder axis, which is engaged between the mounting and the cylinder section of the profile housing and fixes the cap axially.

8. A lock cylinder comprising a profile housing , having a bore, at least one cylinder core disposed rotatably in the bore and having a keyway for a flat key extending in the direction of a cylinder axis, a plurality of tumblers mechanically controllable by the flat key, a first electronic control circuit having a circuit chip and a first coupling coil carried by the circuit chip, the circuit chip being disposed in the region of a front face of the profile housing, the first coupling coil being adapted, upon insertion of a flat key in the keyway, to be coupled with a second coupling coil of a second electronic control circuit for inductive transmission of coding information, the first electronic control circuit, as a function of transmitted coding information, transmitting a control signal representing the lock status, the second electronic control circuit being disposed in a bow of the flat key, and the second coupling coil being disposed on a narrow side of a flat-side widening of a key shank between the bow and an insertion-stop face directed away from the bow and extending in the direction of the shank, the keyway in the region of the front face of the profile housing having on at least one of its narrow sides an opening oriented radially of the cylinder core and facing toward the profile housing, and the first coupling coil being disposed such that, in a rest position of the cylinder core permitting insertion of the flat key into the keyway, the first coupling coil is aligned with and faces toward the opening of the keyway.

9. The lock cylinder of claim 8, and further comprising locking means for locking the cylinder core in response to the control signal representing the lock status.

10. The lock cylinder of claim 8, wherein the first electronic control circuit has electronic components on the circuit chip.

11. The flat key of claim 8, wherein the second coupling coil is disposed in a recess of the flat-side widening, and the key shank has a bore entirely within the interior of the key shank which connects to the interior of the bow, for receiving connecting leads of the second coupling coil.

* * * * *